US006878079B2

(12) United States Patent
Peskin

(10) Patent No.: US 6,878,079 B2
(45) Date of Patent: Apr. 12, 2005

(54) RACQUET GAME WITH FOAM BALL AND NET STAND APPARATUS

(76) Inventor: Roger M. Peskin, 291 Little York - Mount Pleasant Rd., Milford, NJ (US) 08848

( * ) Notice: Subject to any disclaimer, the term of this patent is extended or adjusted under 35 U.S.C. 154(b) by 0 days.

(21) Appl. No.: 10/099,532

(22) Filed: Mar. 15, 2002

(65) Prior Publication Data

US 2002/0094889 A1 Jul. 18, 2002

Related U.S. Application Data

(63) Continuation-in-part of application No. 09/551,277, filed on Apr. 18, 2000.

(60) Provisional application No. 60/137,325, filed on Jun. 3, 1999, and provisional application No. 60/130,815, filed on Apr. 23, 1999.

(51) Int. Cl.[7] ..... A63B 67/00; A63B 67/18

(52) U.S. Cl. ..... 473/474; 473/465

(58) Field of Search ..... 472/92; 473/416, 473/459, 465, 473, 474, 490, 428, 469, 475, 614, 600, 613; 273/317.4, 340, 119 R, 317

(56) References Cited

U.S. PATENT DOCUMENTS

| | | | | |
|---|---|---|---|---|
| 277,551 A | * | 5/1883 | Cunningham | 473/492 |
| RE16,047 E | | 4/1925 | Miller | |
| 2,163,456 A | | 6/1939 | Youngberg | |
| 2,742,931 A | | 5/1956 | Pooley et al. | |
| 2,743,931 A | | 5/1956 | Pooley | |
| 2,930,618 A | | 3/1960 | Glintz | |
| 2,999,431 A | * | 9/1961 | Mitchell | 472/92 |
| 3,069,170 A | | 12/1962 | Dillon, Jr. | |
| 3,776,551 A | | 12/1973 | Schaller et al. | |
| 3,968,968 A | | 7/1976 | Peterson | |
| 4,088,317 A | | 5/1978 | Gierla | |
| 4,415,163 A | * | 11/1983 | Schoenig | 473/492 |
| 4,462,589 A | | 7/1984 | Morgan | |
| 4,463,951 A | | 8/1984 | Kumasaka | |
| 4,538,818 A | | 9/1985 | Sinclair | |

(Continued)

U.S. PATENT DOCUMENTS

FOREIGN PATENT DOCUMENTS

WO WO 87/06484 11/1987

OTHER PUBLICATIONS

"Tennis", Sports: The complete Visual Reference, New York: Firefly Ltd., copyright 2000, pp. 278–283.*

Mateflex II Modular Tennis Surface, website article, Oct. 19, 2001.

Materials Science and Engineering and Introduction, Fourth Edition, William D. Callister, Jr., pp. 443 & 490.

D3574–95 Standard Test Methods for Flexible Cellular Materials–Slab, Bonded, and Molded Urethane Foams, American Society for Testing and Materials, Feb. 12, 2001.

*Primary Examiner*—Gregory Vidovich
*Assistant Examiner*—Alvin A. Hunter, Jr.
(74) *Attorney, Agent, or Firm*—Cowan, Liebowitz & Latman, P.C.; Mark Montague

(57) ABSTRACT

A ball game assembly is disclosed for a ball game to be played with a tennis-type racquet, a net and a foam ball, whose speed and/or action is reduced to increase play activity. The tennis racquet is smaller than a conventional adult tennis racquet, e.g., a junior tennis racquet, and the game is played on a tennis court of reduced size, with a net dividing the court into halves. The ball is larger and lighter in weight than a tennis ball, and it moves slower and has a softer bounce than a tennis ball. Preferably the net is supported across the playing area by net supports that are positioned at mid-court on either side of the court.

7 Claims, 2 Drawing Sheets

U.S. PATENT DOCUMENTS 4,598,909 A 7/1986 Ventura et al.
4,637,616 A 1/1987 Whiting
4,732,395 A * 3/1988 Halverson ..... 473/492
4,772,019 A 9/1988 Morgan
4,834,392 A 5/1989 Nixon
4,844,477 A 7/1989 Pardi
4,927,142 A * 5/1990 Drusel ..... 473/492
4,979,754 A 12/1990 Eisenhart
5,072,947 A 12/1991 Blue
5,123,659 A 6/1992 Williams
5,303,932 A * 4/1994 Kessler ..... 473/492
5,310,189 A 5/1994 Soto
5,326,109 A 7/1994 Robl
5,385,350 A 1/1995 Norman
5,584,487 A 12/1996 Blue
5,615,890 A * 4/1997 Blue ..... 473/469
5,630,589 A 5/1997 Adie et al.
5,655,979 A * 8/1997 Blue ..... 473/475
5,885,173 A 3/1999 Keller
5,951,420 A 9/1999 Talaricao et al.

* cited by examiner

RACQUET GAME WITH FOAM BALL AND NET STAND APPARATUS

CROSS-REFERENCE TO RELATED APPLICATIONS

This application is a continuation-in-part of co-pending U.S. patent application Ser. No. 09/551,277 filed Apr. 18, 2000, which is based upon U.S. provisional patent application Ser. No. 60/137,325, filed Jun. 3, 1999 and U.S. provisional patent application Ser. No. 60/130,815, filed Apr. 23, 1999.

FIELD OF THE INVENTION

The present invention relates to the field of recreational games and to equipment for playing them. More particularly, the invention relates to a net game played with a particular racquet and a foam ball under conditions that achieve a unique playing experience.

BACKGROUND OF THE INVENTION

Games played with a racquet or paddle and a ball run the gamut, and can be played across a net or against a wall. These games include tennis, squash, racquet ball, paddle ball and ping pong. Tennis has perhaps the widest appeal of all of these games. It is played professionally and can be followed in person in large sports stadiums, on TV, and in print. Tennis can be played at many levels of skill and speed, and people in almost all age groups and physical condition play tennis for different reasons competitively, recreationally, and/or socially.

Because of the size and composition of a tennis ball, the velocity at which it can be hit, and the size of a tennis court, volleys tend to be short and, in many cases, frustrating. For many players, tennis would be more fun if the pace could be maintained at many levels of play, or even increased, for example, if volleys can be sustained longer without so slowing down ball movement and/or action as to unduly detract from game play.

While there are a number of other recreational games that use racquets and paddles and a net, or that may be played similar to tennis but less rigorously and/or more slowly (i.e., slower ball speed and player movement), they correspondingly do not provide the game play of tennis. Some of these games are played with a foam or wiffle ball. Examples of such games and of foam and wiffle balls are described in, for example, U.S. Pat. Nos. 5,072,947 (Blue); 4,457,513 (Thompson); 3,671,040 (Meyer et al.); 2,743,931 (Pooley et al.); 3,069,170 (Dillon); 4,772,019 and 4,462,589 (Morgan); 4,463,951 (Kumasaka); 4,538,818 (Sinclair); and 5,123,659 (Williams). None of these references describes or suggests a game played similarly to tennis with a foam ball and a particular racquet under conditions that surprisingly maintain, or increase play activity to provide a high tennis game play value.

OBJECTS OF THE INVENTION

It is an object of the invention to provide a recreational game and equipment for playing it.

It is also an object of the invention to provide a net game played with a particular racquet and a foam ball under conditions that achieve a unique playing experience.

It is a further object of the invention to provide a game played similar to tennis using a tennis racquet, a net, and a ball in which ball speed and/or action is reduced while increasing, or at least not significantly reducing, play activity.

These and other objects of the invention will become more apparent from the discussion below.

SUMMARY OF THE INVENTION

The invention provides a game played like tennis with a tennis racquet, a net, and a ball in which ball speed and/or action is reduced while increasing, or at least not significantly reducing, play activity. In a preferred embodiment, the invention includes one or more preferably all, of the following: a tennis racquet that is smaller than a conventional adult tennis racquet, e.g., a junior tennis racquet, that has a length of approximately 23 inches; a foam or other ball having the characteristics described below; a tennis court of reduced size, e.g., 40 feet long by 20 feet wide, with the net dividing the court into 20-foot halves; and a resilient surface, e.g., one comprised of polymeric athletic tiles.

The ball according to the invention is larger and lighter in weight than a tennis ball, and moves slower and has a softer bounce than a tennis ball. Yet, the ball moves with sufficient speed and has sufficient bounce action off the tennis racquet and tennis court floor to be challenging to players of a wide range of skill levels, physical conditions, and ages. The ball is not overly slowed by air resistance, and is neither too large as to be bulky in play nor too small as to be hard to hit. In other words, the speed and action of the ball is not too lethargic and thus enables rallies to be sustained for longer periods of time, thereby increasing the game value.

Because the ball moves more slowly through the air than does a tennis ball and has a softer bounce, a participant has more time to react to the ball. Due to this and the fact that the size of ball provides a better target, a participant has a better chance of hitting the ball properly, that is, hitting it into the in-bounds area of the opponent's court. Since each player has this same advantage provided by slower movement and softer bounce of the ball, the number of successful hits is increased and the result is that the rallies are longer.

Due to the use of a smaller stringed racquet, e.g., a junior tennis racquet, power is reduced and control is maximized, which also extends rallies and contributes to the playing experience. This provides the experienced athlete a game with more chances and, therefore, more physical activity (a better workout) than tennis. For the less experienced athlete, the slower motion of the ball and greater racquet control also extends the rallies and increases the possibility of extended exercise. The players, with a greater sense of control, have more of a chance of enjoying a racquet sport, i.e., having more fun, without the frustrations of a beginning tennis player. By providing a greater success rate of hits, the invention gives both the experienced and less experienced player a better chance of achieving extended play, greater exercise, and greater enjoyment.

The preferred embodiment of the invention provides a foam ball with the movement, bounce and play characteristics described herein.

The net, which is preferably slightly lower than a standard tennis net, e.g., about 33 to about 34 inches high, is supported across the playing area by net supports that are positioned at mid-court on either side of the court. The supports may be held in any suitable manner. In accordance with one embodiment, each support includes a post with a stake which is inserted into the ground, and cords that are attached to the post and fixed to the ground by additional stakes. In accordance with another embodiment, where stakes are not suitable or desirable, each support has a weighted base and a vertically disposed post preferably cantilevered upward from the base. The weighting of the weighted base could be effected by sand, water, or other suitable weighting material. The particular type of net employed, or the way in which it is suspended, is not critical to the invention. For example, each end of the net could be fastened in the manner as a conventional tennis net and/or the net could have cords attached at its top and bottom in order to be tied to the post and cause the net to be suspended between the posts in a taut condition. In one embodiment, a bungee-type cord extends from the top of the post to an attachment point on the base to prevent the post from leaning inward as a result of the attached net.

BRIEF DESCRIPTION OF THE DRAWINGS

The above and other objects and advantages of the invention will be apparent upon consideration of the following detailed description, taken in conjunction with the accompanying drawings, in which the reference characters refers to like parts throughout and in which.

DETAILED DESCRIPTION OF THE INVENTION

Figure 1:
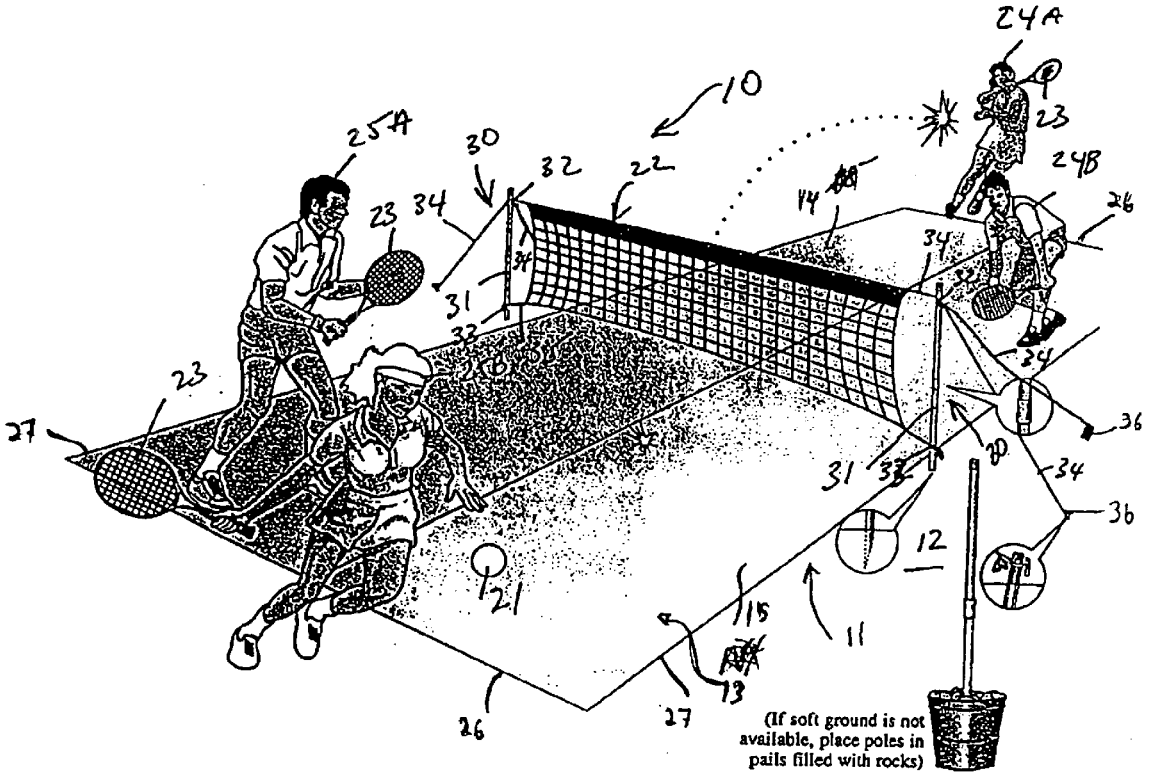
FIG. 1 shows a perspective view of several participants playing the game of the present invention.

With reference to the drawings, and especially to FIG. 1 thereof, the game of the invention is illustrated generally at 10 and is shown being played between two opposing teams of two players each on a court 11 of prescribed configuration and measurements. Court 11 extends along a horizontal and generally rectangular playing surface 13 and includes first 14 and second 15 opposed playing areas extending in opposite longitudinal directions from a central court position lying equally between the two playing areas 14,15 and being separated by a net 22. Each playing area 14,15 has a baseline 26 and opposite sidelines 27 extending from the central court position to the corresponding baseline. Both sidelines 27 and both baselines 26 are parallel and are considered the "out-of-bounds" lines for the court area. The dimensions of the court area preferably include a total playing area of about 20 feet wide by about 40 feet long, with an inbounds area of about 16 feet wide by about 32 feet long. Therefore, the inbounds area on each side of the net will be about 16 feet square, with a 2 foot out-of-bounds area on each side and a 4 foot out-of-bounds area at each end. Playing surface 13 should preferably be sufficiently hard so that it provides the proper resistance to enable a soft foam ball 21 to bounce thereon, and should preferably be level and smooth so that the bounce of ball 21 is true and unaltered. Surfaces that are typically used are a driveway, a garage, a hard grass surface, etc., or an indoor space such as a large basement or garage. In an especially preferred embodiment of the invention, the playing surface will comprise a resilient surface such as polymeric athletic tiles. Such tiles, which have a grid configuration and snap or otherwise fit together, provide a flexible and resilient surface that creates a desired and/or appropriate bounce to the ball. Such tiles are readily available, such as, e.g., the tiles known as MATEFLEX™II tile modules, available from Mateflex, Inc., Utica, N.Y.

In FIG. 1, game 10 is shown being played by two opposed teams, with each team having two players, 24A,B and 25A,B, with the players of each team being placed in a corresponding playing area (players 24A,B in area 14 and players 25A,B in area 15) and being separated from the players of the other team by a net 22. Game 10 could of course also be played with one player on each team, each player being placed in his corresponding playing area and being separated from the other player by net 22. As with tennis, a game with one player on each side is called "singles," and a game with two players on each side is called "doubles."

Each player 24A,B, 25A,B carries a racquet 23 for hitting the game ball 21. In this game, racquets 23 are conventional junior size tennis racquets, a junior size tennis racquet of a length of about 23 inches big especially preferred. Typically, each racquet 23 has an elongated handle portion and an enclosed striking or head portion within which is a set of strings is strung similar to a standard tennis racquet, except that the head diameter and handle length are both reduced.

Figure 2:
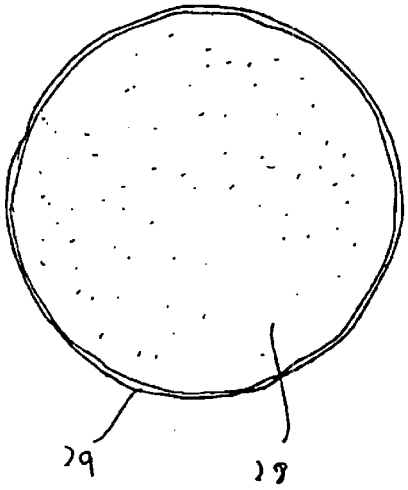
FIG. 2 shows a cross-sectional view of the ball that is to be used in the game of the present invention.

As shown in FIG. 2, ball 21 of this invention is a spherical foam ball. The construction of the ball, e.g., the size, weight, density, foam, an outer coating, etc., is such as to provide ball speed and action that is not too slow or lethargic, but yet fast enough to provide a high game play value. A foam ball with the characteristics described below provides just such ball movement and action off of typical playing surfaces and conventional tennis racquets which are slightly smaller than adult size.

The foam is preferably an open cell foam 28. Ball 21 is preferably formed of polyurethane foam but may also be made of other types of foam, without departing from the principles of the invention. Most preferably, ball 21 is formed of polyether ultracell foam, grade 5209H059. The ball 21 is slightly larger than a standard tennis ball, about 3½ to about 4½ inches in diameter, preferably from about 3½ to about 4 inches in diameter, and approximately 4 inches in an especially preferred embodiment. Made with a suitable foam, the ball is lightweight, about ¾ oz to about 1¼ oz, preferably about 1 oz for a 4 inch ball. The game ball 21 is sufficiently dense, strong, flexible, resilient, compressible and durable so as to withstand repeated and sustained impact by the players' racquets at various angles and forces. In particular, using the ANSI/ASTM D3574-91 test standards, the preferred foam ball has a density of approximately 2.75–2.85 lb./ft$^3$ (42–44 kg/m$^3$) (Test A), a minimum tensile strength of approximately 15 psi (100 KPA) (Test E), a minimum tear strength of 1.5 lb./inch (263 N/M) (Test F), a minimum ultimate elongation of 150% (Test E), a minimum support factor for 65%/25% of 2.4, a minimum resilience of 55% (Test H), and a maximum compression of 10% after 90% compression for 22 hours at 158° F. (70° C.). A 15"×15"×4" block sample of the foam material was tested for additional desirable properties, and the preferred material was found to have an indentation deflection force of 50–60 lb./50 inches$^2$ (220-270 N/323 cm$^2$) for 25% deflection at 4 inches (100 mm) and a force of 120–156 lb./50 inches$^2$ (534–594 N/323 cm$^2$) for 65% deflection at 4 inches (100 mm)(Test B).

Ball 21 could also preferably have a thin layer 29 of coating, which is preferably an acrylic resin. Most preferably, the resin is a methacrylic resin, a thermoplastic polymer of methacrylic acid, i.e., $CH_2{:}C(CH_3)COOH$. When ball 21 is treated to have such a coating, its external foam cells 28 are sealed with the resin coating 29 and the durability of ball 21 is enhanced. Then, ball 21 will take a considerably greater amount of time to wear down and get frayed than it does without coating 29. Acrylic coating 29 also provides ball 21 with slightly more weight and a certain amount of desirable aerodynamic characteristics, e.g., less air resistance and less susceptibility to wind, and thus more stability. The coating also provides water and stain or dirt resistance, which, because the game disclosed herein is often played outdoors, reduces water absorption in wet conditions. Coatings of different color may be applied to provide different colored balls. Ordinary exterior latex paints may also be suitable.

As stated, the two opposing playing areas 14,15 are separated by net 22 that is suspended across playing area 11 and supported in such a position by net support units 30 that are positioned midway along the sidelines on either side of the court 11. If the ground 12 under the playing surface 13 is soft, a tapered pole 31 may be used at each side to support net 22. Poles 31 may be driven into ground 12 so that poles 31 are sturdy. Each of poles 31 has holes 32,33 drilled therethrough, one hole 32 near the top of pole 31 and a second hole 33 near the bottom of pole 31. Each end of net 22 has cords 34, 35 (one, two or more of each as necessary) attached spaced along the width of the end of net 22, most preferably at the far comers of the end of net 22. When net 22 is supported across court 11 such that in forms a vertical plane, cords 34,35 are situated at the top and bottom of each end of net 22. Cords 34,35 are tied to pole 31 through holes 32,33 and cause net 22 to be suspended between poles 31 in a taut condition. As an additional precaution against net 22 drooping, top cord 34 can be strung through top hole 32 of pole 31 and secured to one or more stakes 36 driven into ground 12 a short distance outward from pole 31 and playing field 13.

Figure 3:
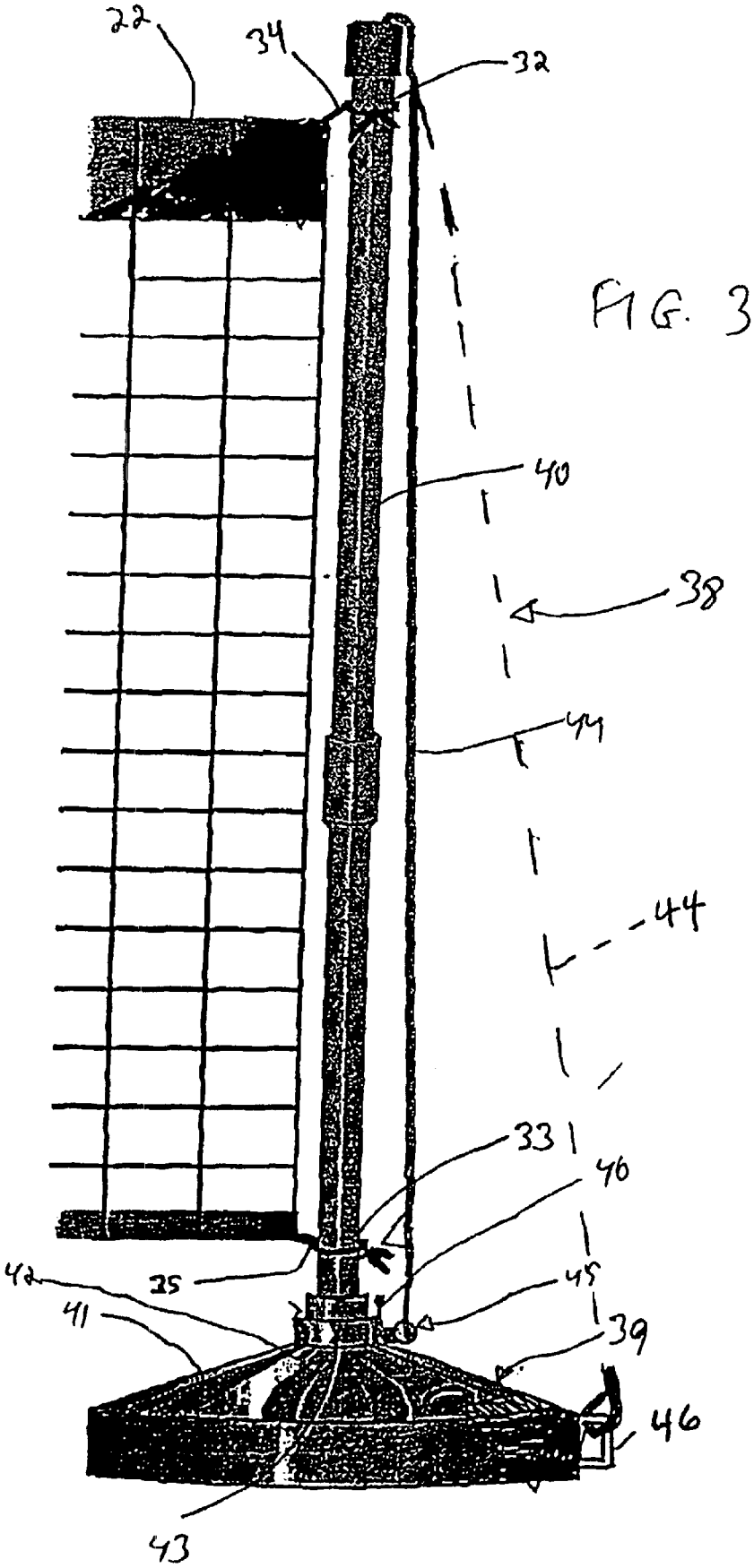
FIG. 3 shows a perspective view of a net support that supports one end of the net.

If the ground 12 under the playing surface 13 is hard and does not allow poles 31 to be driven into the ground 12 sufficiently to provide support for net 22, or if, for example, polymer athletic tiles are used for the playing surface, net support stands 38 may be used. As shown in FIG. 3, each net support stand 38 has a wide, weighted base 39 and a vertically disposed post 40 preferably cantilevered upward from and coaligned with base 39. Base 39 can be similar to the type used as supports for lawn umbrellas, and is generally filled with sand, rocks, water or some other dense material to add extra weight and provide a considerably lower center of gravity for the net support stand 38 and prevent it from toppling. Base 39 could be a disc-shaped weight member, with a cap 41 that has a central aperture 42 through which post 40 is inserted. Post 40 is fixed within base 39 and is prevented from further wobbling within base 39 by a collar or reducer 43 that is fixed in central aperture 42. As discussed previously, cords 34,35 are tied to post 40 and cause net 22 to be suspended between the posts 40 in a taut condition.

Since net supports 38 are movable and are not fixed to the ground 12 about the playing surface 11, it is possible that the tension between the ends of net 22 could cause post 40 to lean or tilt within base 39. Accordingly, this invention provides for a mechanism for preventing this from happening. A stretchable cord 44, known generally as a bungee-type cord, extends from the top of post 40 to an attachment point 45 on the base 39. The attachment point 45 could be any means for joining the end of the bungee cord 44 to base 39 for preventing post 40 from leaning inward as a result of the attached net 22. Preferably, attachment point 45 is a set screw or pin which fixes post 40 within base 39. A hook 46 attached to the far end of bungee cord 44 hooks about the attachment point 45. Alternatively, the far end of the bungee cord 44 may be connected to a handle 46 on the base, as shown in broken lines. In either of these ways, cord 44 provides a force in the direction opposite to the force of the tension of net 22.

The rules of the game are somewhat similar to those of tennis, except that, as will be discussed later, this game has a much wider applicability for players than does tennis due to the slower pace of the game caused by the ball. One player 24A on the first team, designated as the "server," stands behind baseline 26, also known as the service line, and serves by hitting ball 21 with his/her racquet 23 in an underhanded fashion into the corresponding opposing playing area 15 on the other side of net 22, bounded by baseline 26 and sidelines 27. Ball 21 should land within the opposing playing area 15 without first bouncing into the serving team's playing area 14. If ball 21 lands outside the opposing playing area 15, it becomes the receiving team's turn to serve. If ball 21 lands within the receiving team's playing area 15, one of the players 25A, 25B on the receiving team may strike ball 21 with his/her racquet 23 and return ball 21 into the serving team's playing area 14. A player 24A, 24B on the serving team may then, either before or after ball 21 has bounced once, strike ball 21 with his/her racquet 23 and return ball 21 back into the receiving team's playing area 15. This rally continues until one player either misses the ball or hits it out of bounds or into the net. If a player on that rally's serving team had mis-hit the ball, then the serve passes to the other team. If a player on that rally's receiving team had mis-hit the ball, then the serving team shall be credited with a point and shall serve the ball once again. The Appendix contains more details on game rules and game play.

Figure 4:
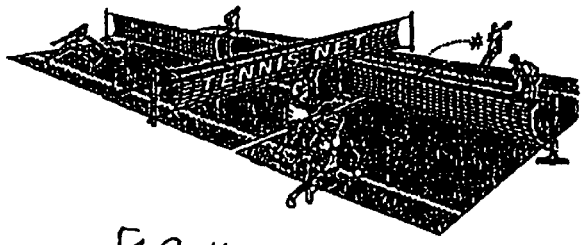
FIG. 4 is a perspective view two sets of participants playing separate games on opposite halves of the same full size tennis court.

The preferred court size for this game is approximately 20 feet by 40 feet. However, the dimensions of the playing field may be varied to adjust for various levels of skill and available space. One advantage to this game is that it can be played on a standard size tennis court, preferably using only the service lines on half a tennis court as shown in FIG. 4. If desired, two games may proceed simultaneously on a single tennis court. Thus, it will be appreciated that the game requires only a small space to play. Also, since the ball is made of a soft material, the surface of the court requires no special preparation or finish, and the game may be played indoors or outdoors on a wide variety of playing surfaces. Alternatively, the entire tennis court may be used, but a larger court may reduce volley length, just as in tennis.

The instant invention was developed from one and only one focal point: the sport of tennis. The idea was to create a game similar to tennis with added benefits. Certain characteristics of the tennis game, namely, the size of the court, the size of the racquets, and the size and the lively bounce of the tennis ball make the game of tennis difficult for the less experienced player. Due to adjustments to the size of the court, the size of the racquets, and the size and bounce of the ball, the invention unexpectedly results in a new and unique playing experience that makes the invention, also known as ROGERBALL, an easier game to play than tennis.

The limited court size according to the invention confines the play so that the ball must be hit inbounds into a smaller area than tennis, thereby, generating more hits and extended rallies. Due to the size of the court a net slightly lower than the standard tennis net is preferably used. The smaller (junior) racquets maximize control and minimize power, again adding to the number of inbound hits and lengthening the rallies. The foam ball (approximately four inches in diameter) moves at a slower pace than the tennis ball, both in the air and off the bounce, so that it is easier to hit, again increasing inbound hits and lengthening the rallies. In addition, the size of the ball makes it a bigger target and, therefore, easier to hit.

The result of the above selection of components is a simple but eloquent synergy, creating a new and unique game that is both easier to play than tennis and more enjoyable. An added benefit is that, because the invention generates longer rallies, the game can be an intense aerobic workout, especially for the experienced athlete. The benefits are especially helpful to the younger and older players who find the invention less frustrating and more enjoyable than tennis because the game is easier. This, hopefully, increases the potential number of people who can participate and enjoy a racquet sport.

In addition, relatively low cost and portability are significant aspects of the system. These features make the system attractive to the general public, which may not have the opportunity or financial wherewithal to play on a standard tennis court.

One skilled in the art will appreciate that the present invention can be practiced by other than the described embodiments, which are provided for purposes of illustration and not limitation, and that the present invention is limited only by the claims that follow.

What is claimed is:

1. A ball game assembly for playing a tennis-like ball game in which opposing players return a ball within a prescribed playing unit extending along a horizontal playing surface in opposite longitudinal directions over a net, comprising:

at least two junior tennis racquets, each having a handle portion and a head portion;

a net;

a net apparatus for supporting the net in a vertical plane at substantially regulation tennis height or less across a playing court; and a soft resilient foam ball, said ball being sufficiently dense, resilient, compressible and durable so as to withstand repeated and sustained impact by said racquets at various angles and forces, wherein said ball has a diameter from about 3.5 to 4.5 inches, weighs from about 0.75 to 1.25 oz., is formed of an open-celled, spherical construction, has a surface layer coating of acrylic ream or latex paint, and has a maximum compression of 10% after 90% compression for 22 hours at 158°F. (70°C.), wherein said ball may be struck by said racquets and returned over said net or bounced off said playing court at a reduced speed, and wherein the players achieve the sense and feel of playing regular tennis while being able to play at a reduced pace and with less skill than is normally required.

2. A ball game assembly for playing a tennis-like ball game in which opposing players return a ball within a prescribed playing unit extending along a horizontal playing surface in opposite longitudinal directions over a net, comprising:

a playing surface disposed in or immediately above the ground;

at least two junior tennis racquets, each having a handle portion and a head portion;

a net;

a net apparatus for supporting the net in a vertical plane at substantially regulation tennis height or less across the playing surface; and a soft resilient foam ball, said ball being sufficiently dense, resilient, compressible and durable so as to withstand repeated and sustained impact by said racquets at various angles and forces, wherein said ball has a diameter from about 3.5 to 4.5 inches, weighs from about 0.75 to 1.25 oz., has a maximum compression of 10% after 90% compression for 22 hours at 158°F. (70°C.), is formed of an open-celled, spherical construction, and has a surface layer coating of acrylic resin or latex paint, wherein said ball may be struck by said racquets and returned over said net or bounced off said playing court at a reduced speed, and wherein the players achieve the sense and feel of playing regular tennis while being able to play at a reduced pace and with less skill than is normally required.

3. A ball game assembly for playing a tennis-like ball game in which opposing players return a ball within a prescribed playing unit extending along a horizontal playing surface in opposite longitudinal directions over a net, comprising:

a playing surface disposed in or immediately above the ground;

at least two junior tennis racquets, each having a handle portion and a head portion;

a net;

a net apparatus for supporting the net in a vertical plane at substantially regulation tennis height or less across the playing surface; and a soft resilient foam ball, said ball being sufficiently dense, resilient, compressible and durable so as to withstand repeated and sustained impact by said racquets at various angles and forces, wherein said ball has a diameter from about 3.5 to 4.5 inches, weighs from about 0.75 to 1.25 oz., is formed of an open-celled, spherical construction, has a maximum compression of 10% after 90% compression for 22 hours at 158°F. (70°C.), and has a surface layer coating of acrylic resin or latex paint, wherein said ball may be struck by said racquets and returned over said net or bounced off said playing court at a reduced speed, and wherein the players achieve the sense and feel of playing regular tennis while being able to play at a reduced pace and with less skill than is normally required;

said net apparatus comprising two weighted bases and an upstanding element mounted within each said base, whereby the net is attached to a first upstanding element at one end and to a second upstanding element at another end; said net apparatus further comprising a tension device for preventing said upstanding element from leaning due to tension from said attached net; the tension device comprising a tension cord tat is attached to the top of said upstanding element at a first end to an attachment point on said base at a second end; said attachment point comprising a screw or pin element and the second end of said tension card hooks about said screw or pin element.

4. A ball game assembly for playing a tennis-like ball game in which opposing players return a ball within a presented playing unit extending along a horizontal playing surface in apposite longitudinal directions over a net, comprising:

a playing surface disposed in or immediately above the ground, the playing surface comprising a plurality of interconnected tiles resting on the ground;

at least two junior tennis racquets, each having a handle portion and a head portion;

a net;

a net apparatus for supporting the net in a vertical plane at substantially regulation tennis height or less across the playing surface; and a soft resilient foam ball, said ball being sufficiently dense, resilient, compressible and durable so as to withstand repeated and sustained impact by said racquets at various angles and forces, wherein said ball has a diameter from about 3.5 to 4.5 inches, weighs from about 0.75 to 1.25 oz., is formed of an open-celled, spherical construction, has a maximum compression of 10% after 90% compression for 22 hours at 158°F. (70°C.), and has a surface layer coating of acrylic resin or latex paint, wherein said ball may be struck by said racquets and returned over said net or bounced off said playing court at a reduced speed, and wherein the players achieve the sense and feel of playing regular tennis while being able to play at a reduced pace and with less skill than is normally required.

5. A ball game assembly for playing a tennis-like ball game in which opposing players return a ball within a prescribed playing unit extending along a horizontal playing surface in opposite longitudinal directions over a net, comprising:

at least two junior tennis racquets, each having a handle portion and a head portion;

a net;

a net apparatus for supporting the net in a vertical plane at substantially regulation tennis height or less across a playing court disposed in or immediately above the ground; and a soft resilient foam ball, said ball being sufficiently dense, resilient, compressible and durable so as to withstand repeated and sustained impact by said racquets at various angles and forces;

said ball having a diameter substantially between 3.5 and 4.5 inches, has a maximum compression of 10% after 90% compression for 22 hours at 158°F. (70°C.) and being formed of an open-celled, spherical construction, said ball adapted to be struck by said racquets and returned over said net or bounced off said playing court; and the playing surface comprises a plurality of interconnected tiles resting on the ground.

6. A ball game assembly for playing a tennis-like ball game in which opposing players return a ball within a prescribed playing unit extending along a horizontal playing surface in opposite longitudinal directions over a net, comprising:

at least two junior tennis racquets, each having a handle portion and a head portion;

a net;

a net apparatus for supporting the net in a vertical plane at substantially regulation tennis height or less across a playing court disposed in or immediately above the ground; and a soft resilient foam ball, said ball being sufficiently dense, resilient, compressible and durable so as to withstand repeated and sustained impact by said racquets at various angles and forces;

said ball having a diameter substantially between 3.5 and 4.5 inches being formed of an open-celled, spherical construction, said ball adapted to be struck by said racquets and returned over said net or bounced off said playing court; and the ball has a maximum compression of 10% after 90% compression for 22 hours at 158°F. (70°C.).

7. A method of playing a tennis-like ball game, comprising the steps of:

supplying a first player with a first junior tennis racquet and supplying a second player with a second junior tennis racquet, each of the first and second racquets having a handle portion and a head portion;

supporting a net in a vertical plane at substantially regulation tennis height or less across a playing surface;

supplying a soft resilient foam ball having a maximum compression of 10% after 90% compression for 22 hours at 158°F. (70°C.), having a diameter substantially between 3.5 and 4.5 inches and being formed of an open-celled, spherical construction that is sufficiently compressible and durable, and adapted to withstand repeated and sustained impact by the racquets at various angles and forces; and hitting the ball between the first and second players in accordance with a set of rules.

* * * * *